United States Patent [19]

Hanamoto et al.

[11] 4,062,216

[45] Dec. 13, 1977

[54] METAL BENDING METHODS AND APPARATUS

[75] Inventors: Yukimitsu Hanamoto, Yokohama; Shigeki Unoki, Kobe, both of Japan

[73] Assignee: Daiichi Koshuha Kogyo Kabushiki Kaisha, Japan

[21] Appl. No.: 593,961

[22] Filed: July 8, 1975

[30] Foreign Application Priority Data

| | | |
|---|---|---|
| July 23, 1974 | Japan | 49-83756 |
| Sept. 13, 1974 | Japan | 49-104873 |
| Sept. 13, 1974 | Japan | 49-104874 |
| Sept. 27, 1974 | Japan | 49-115691 |
| May 30, 1975 | Japan | 50-64956 |

[51] Int. Cl.[2] ..... B21D 7/16

[52] U.S. Cl. ..... 72/128; 72/369

[58] Field of Search ..... 72/128, 149, 152, 155, 72/342, 364, 369

[56] References Cited

U.S. PATENT DOCUMENTS

| | | | |
|---|---|---|---|
| 785,083 | 3/1905 | Brinkman | 72/128 |
| 1,996,838 | 4/1935 | Snell | 72/369 |
| 2,461,323 | 2/1949 | Hille | 72/342 |
| 3,328,988 | 7/1967 | Schmidt | 72/128 |
| 3,368,377 | 2/1968 | Hirayama et al. | 72/128 |
| 3,896,649 | 7/1975 | Stuart | 72/128 |
| 3,902,344 | 9/1975 | Stuart | 72/128 |

*Primary Examiner*—E. M. Combs

*Attorney, Agent, or Firm*—Burns, Doane, Swecker & Mathis

[57] ABSTRACT

This invention relates to methods and apparatus for accomplishing bending work on long metal materials such as pipe, bar and rod.

6 Claims, 37 Drawing Figures

| | | 1 | 2 | 3 | 4 | 5 | 6 |
|---|---|---|---|---|---|---|---|
| | C–T | 614.8 | 609.5 | 608.0 | 602.4 | 596.9 | 593.8 |
| | N–N' | 602.5 | 606.5 | 609.2 | 611.0 | 608.8 | 611.3 |
| | C–T | 611.8 | 612.5 | 612.3 | 605.4 | 605.2 | 606.2 |
| | N–N' | 609.3 | 610.0 | 611.0 | 609.6 | 606.5 | 605.5 |

| 7 | 8 | 9 | 10 | 11 | 12 | 13 |
|---|---|---|---|---|---|---|
| 594.5 | 594.3 | 595.5 | 600.0 | 604.2 | 610.0 | 614.3 |
| 611.5 | 610.7 | 609.5 | 606.3 | 607.3 | 609.0 | 604.2 |
| 604.8 | 605.5 | 605.2 | 605.9 | 611.0 | 611.4 | 612.2 |
| 608.1 | 607.2 | 607.4 | 607.8 | 612.5 | 612.0 | 612.0 |

FIG. 11a
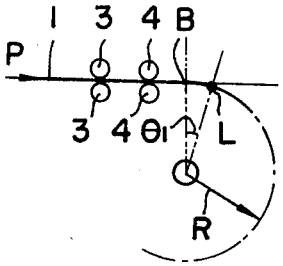
FIG. 11b
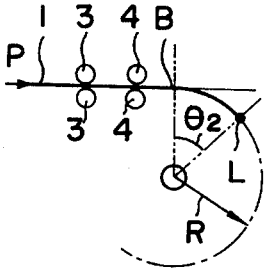
FIG. 11c
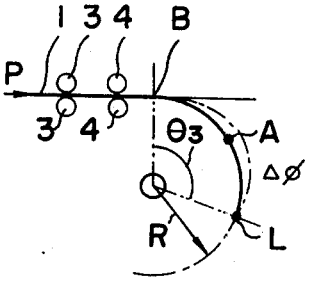
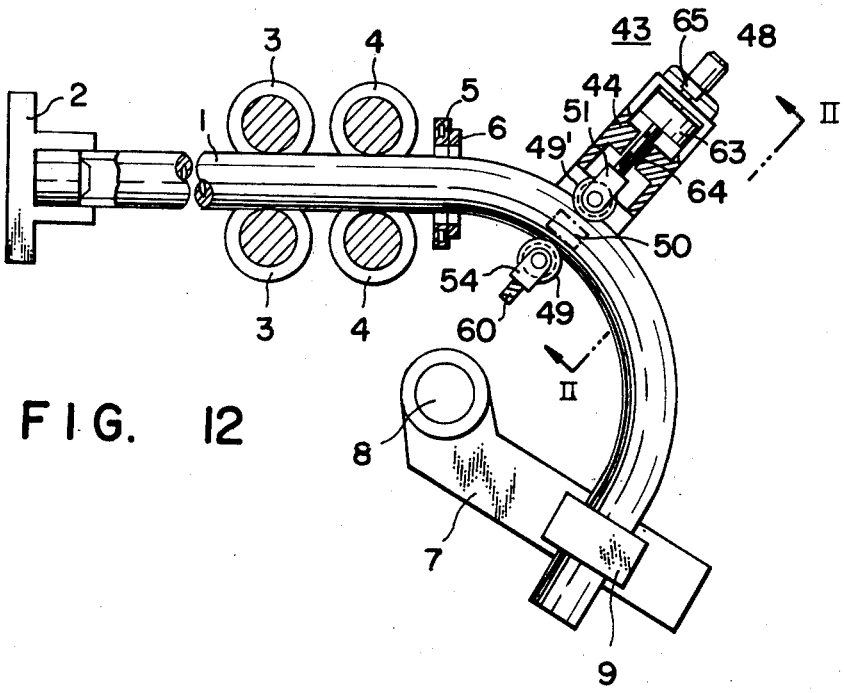
FIG. 12

METAL BENDING METHODS AND APPARATUS

BACKGROUND OF THE INVENTION

There are known two general methods for accomplishing bending work on metal pipes, rods, or the like. In cold bending the desired bending work is performed by giving to the work piece a bending moment that exceeds the elastic limit of the work piece at normal temperature. In hot bending the bending work is accomplished by giving a bending moment to the work piece by heating it to a temperature that induces plastic deformation of the work piece. Cold bending is suited for relatively small diameter metal pipes or the like of which no high product precision is required, but it is not suited for relatively large diameter metal pipes or the like of which high product precision is required. On the other hand, hot bending is suited for relatively large diameter metal pipes or the like of which high product precision is required, but fairly large-scale equipment and heating apparatus is required. Also, as work efficiency is poor, the working cost is high.

Attempts have been made to overcome these problems, and there have been recently developed and put to practical use an improved method and apparatus for effecting bending work by hot bending, according to which a metal pipe or the like to be worked is first passed through a heating device such as for example a high frequency inductor which is capable of effecting high temperature heating over a limited area, with the end or a suitable middle part of said pipe being clamped to an arm which is freely swingable and whose axis of revolution is located within the plane of said heating device, the arm also having a length that matches the bending radius of said pipe. Then, with the pipe being continuously driven straight forward, it is subjected to local heating to a plastic deformation inducing temperature by said heating device, which is immediately followed by cooling so as to effect continuous plastic deformation in said heated area of said pipe while giving a bending moment to said pipe, thereby to accomplish the desired bending.

According to this method and apparatus, the desired bending can be accomplished on solid metal materials very efficiently with high precision, but when hollow metal pipes are subjected to bending, there takes place in some cases a phenomenon detrimental to the product, such as flattening, flexing or buckling in the pipe, and this may cause a change of curvature increasing or reducing the bending radius of the pipe (such phenomenon being hereinafter referred to as "R flow"). Also, when the clamp is released upon completion of the bending, there may occur so-called spring back to cause expansion of the bending radius (hereinafter referred to as "R expansion").

In recent years, pipelines are popularly used for the transportation of fluids, and the number of steel pipes used for such pipelines is increasing at a high rate. Also, more and more high precision is required for bending such pipes.

Thus, demand has been voiced in the industries for development of a method and apparatus which are capable of effecting bending metal pipes such as steel pipes with higher precision than is attainable with the presently available techniques.

In view of the above, the present invention has for its object to provide a method and apparatus which are capable of bending long metal materials such as pipe, bar and rod with high efficiency and high precision.

It is another object of the present invention to provide a method and apparatus which are capable of bending steel pipes used for constructing pipelines for fluid transport without causing any undesirable phenomenon such as flattening, flexing or buckling, that is, R flow or R expansion.

THE DRAWINGS

Figure 1:
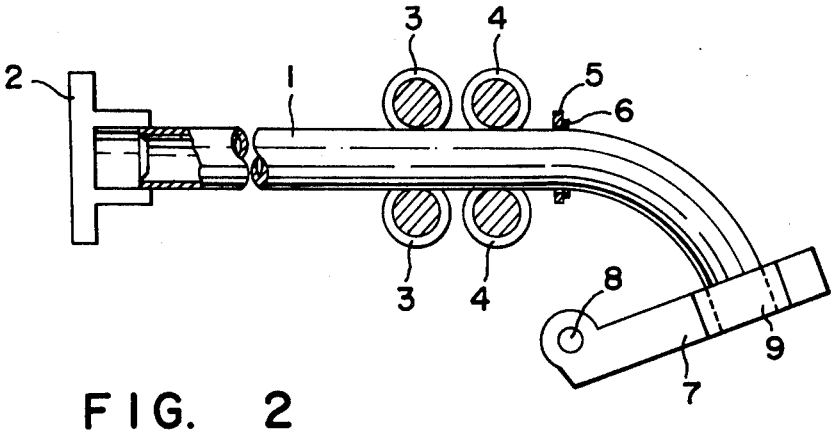
FIG. 1 is a plan view of a conventional apparatus which serves as a basis for the present invention.
Figure 13:
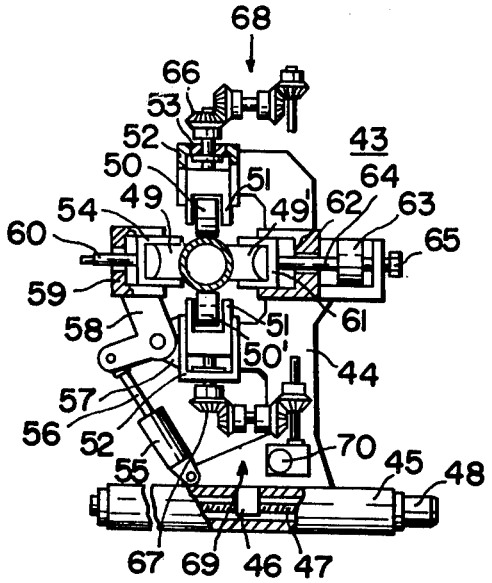
Figure 14:
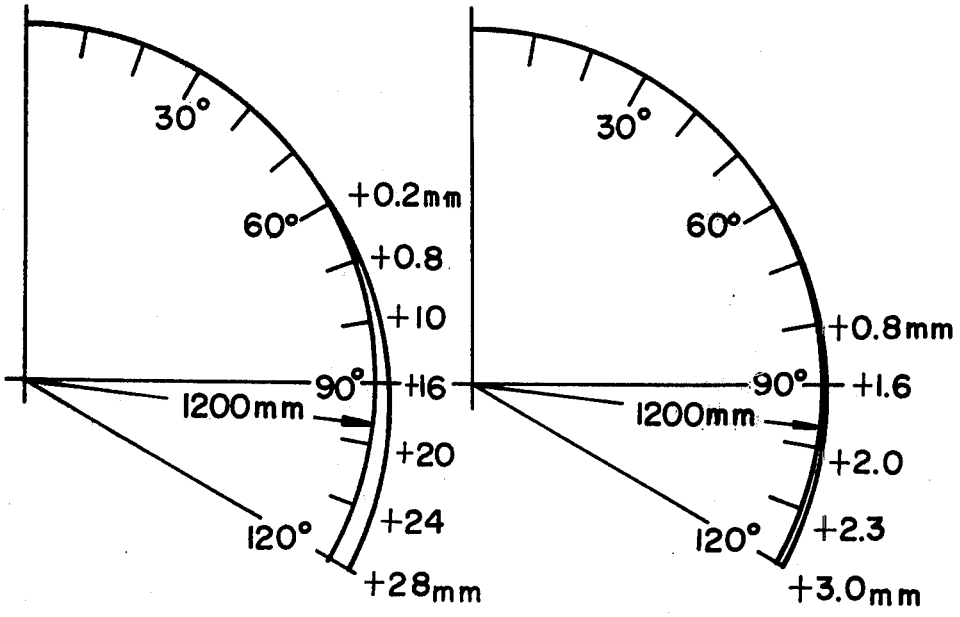
Figure 15:
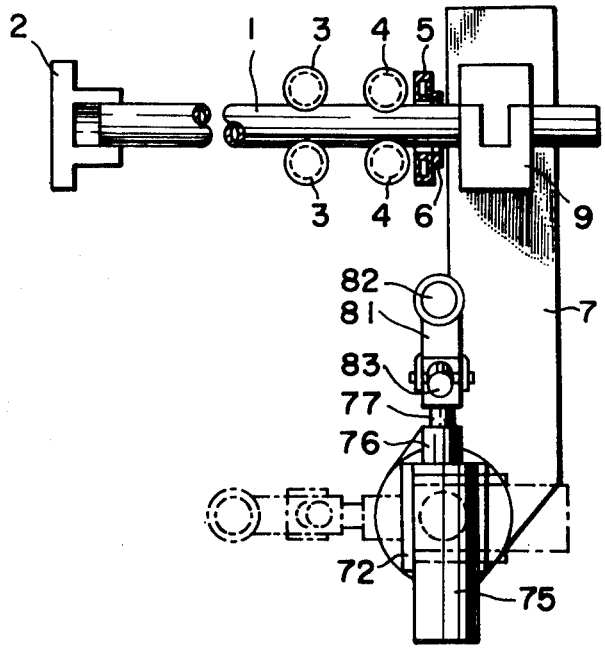
Figure 16:
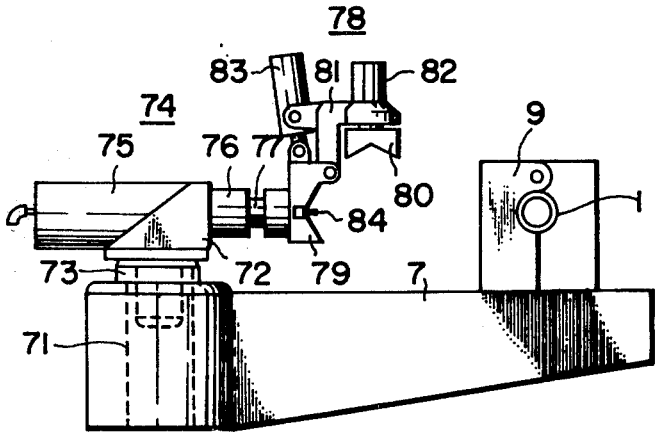
Figure 17:
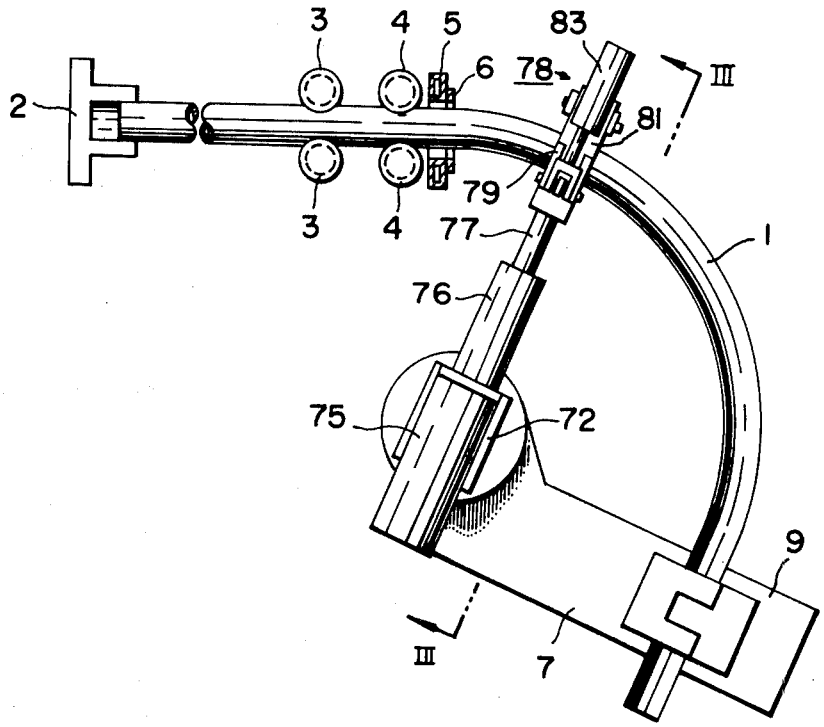
Figure 18:
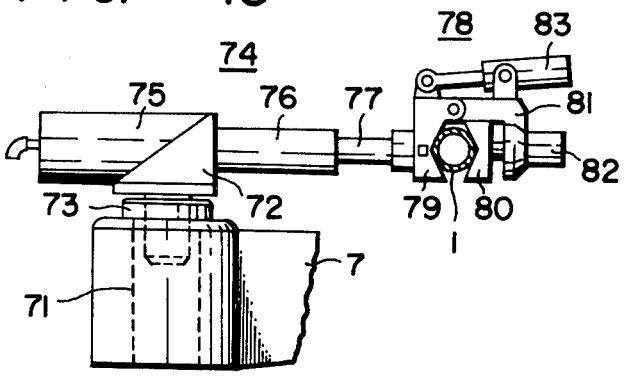
Figure 19:
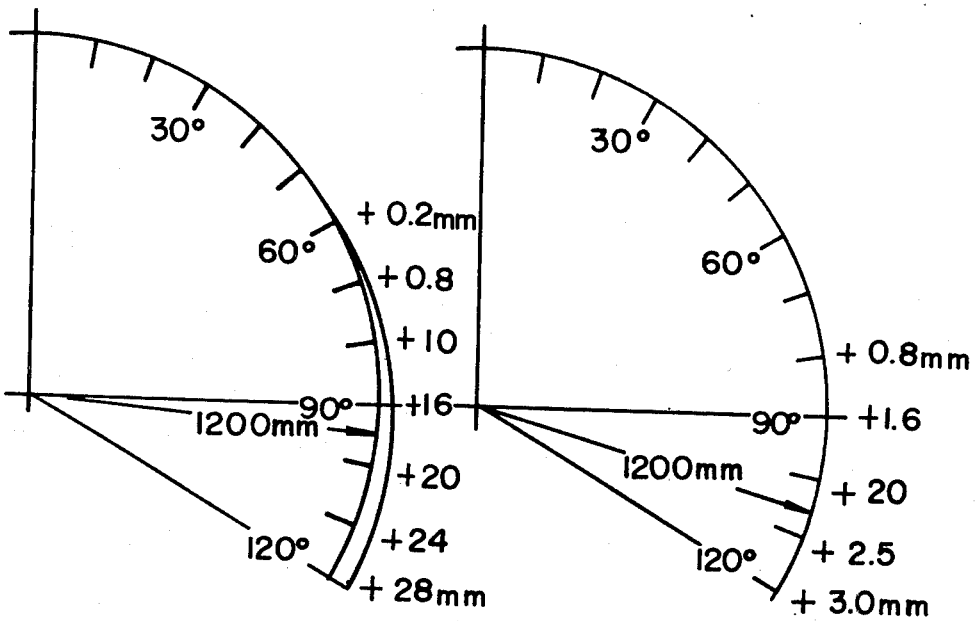
Figure 20:
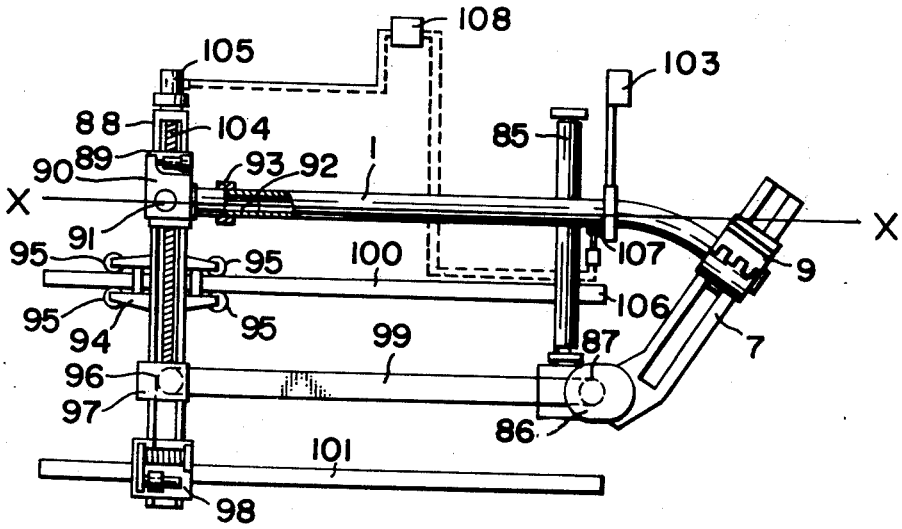
Figure 21:
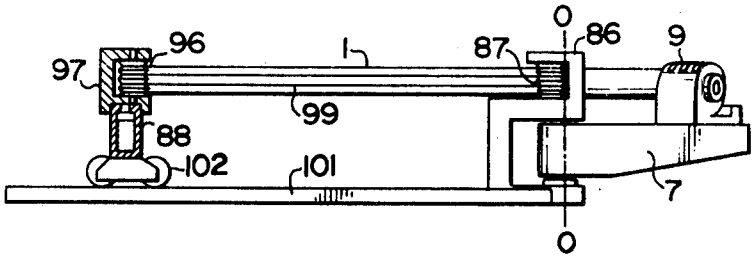
Figure 22:
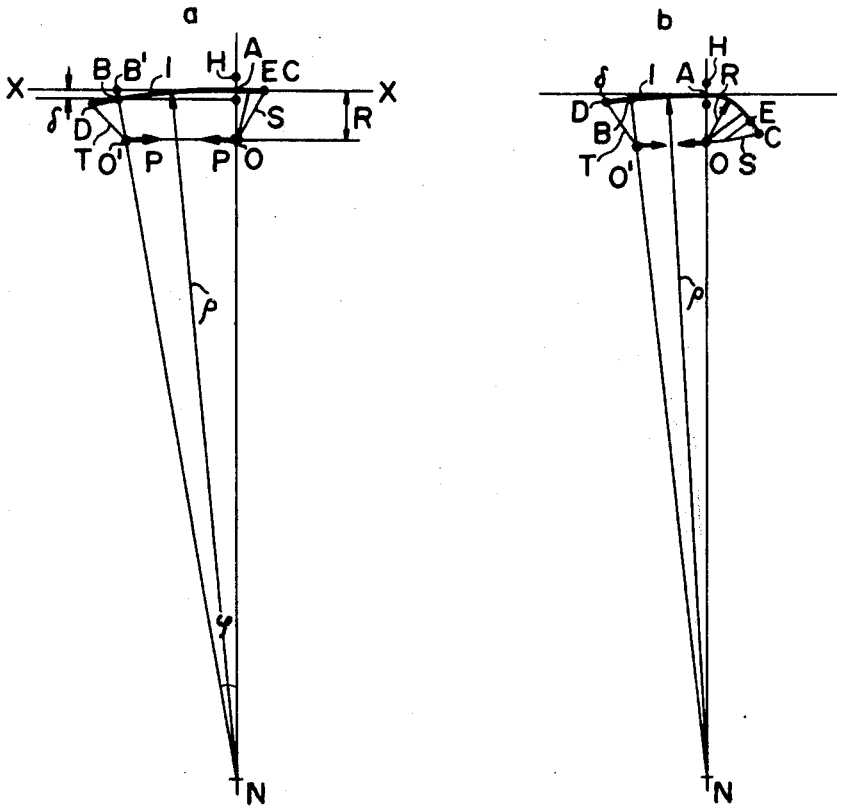
Figure 23:
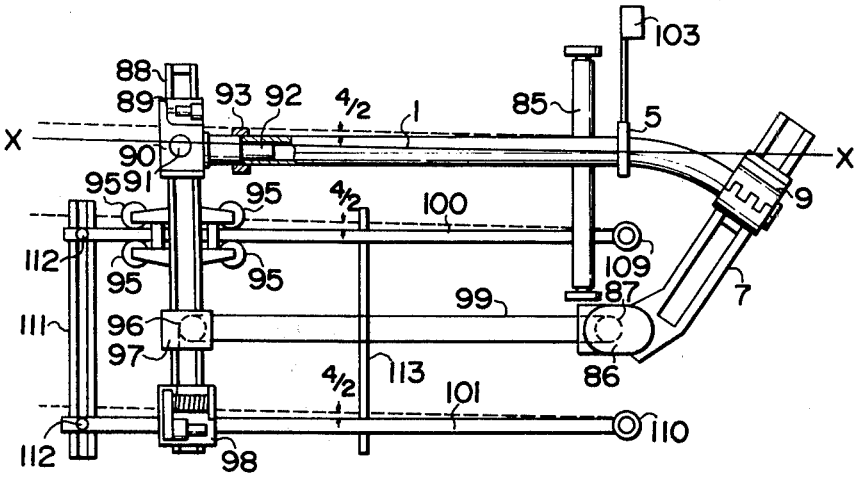
Figure 24:
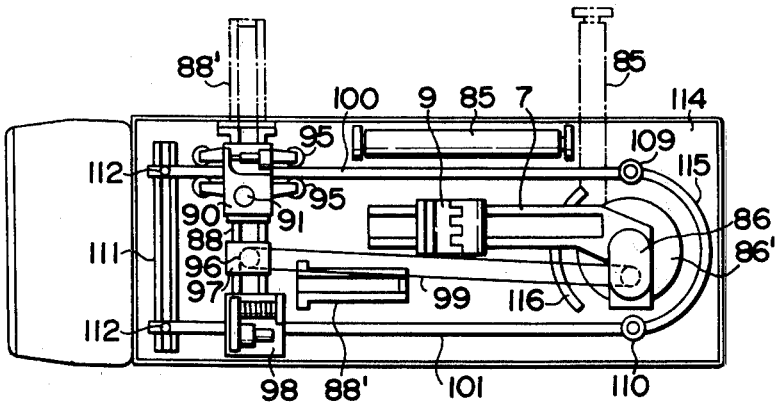
Figure 25:
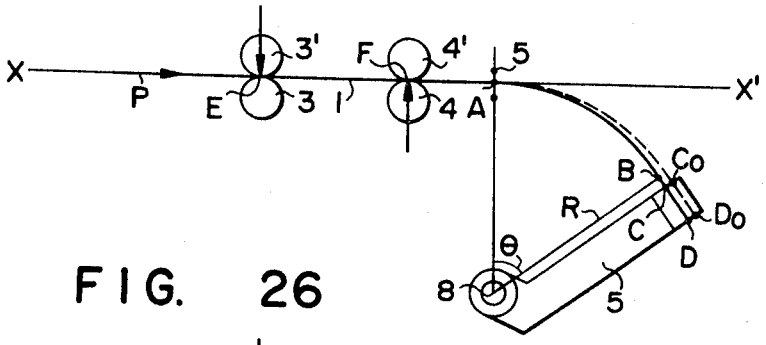
Figure 26:
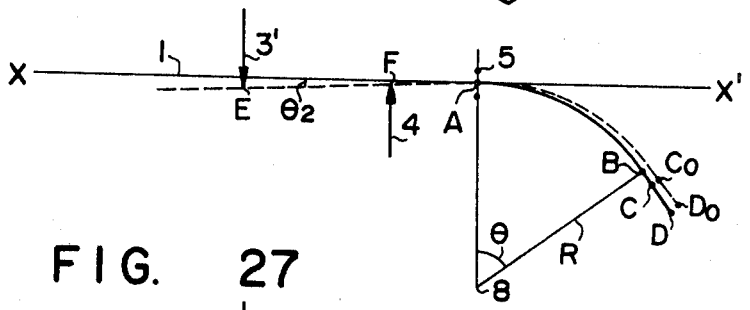
Figure 27:
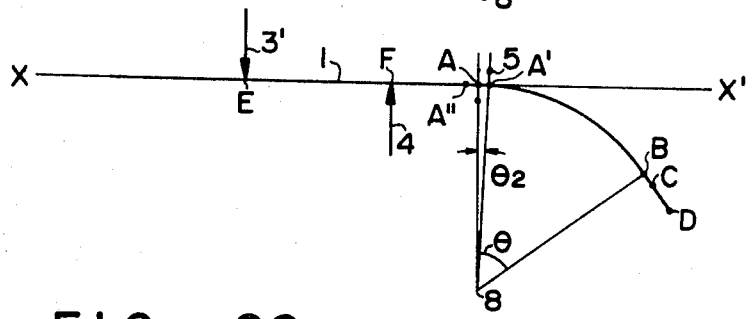
Figure 28:
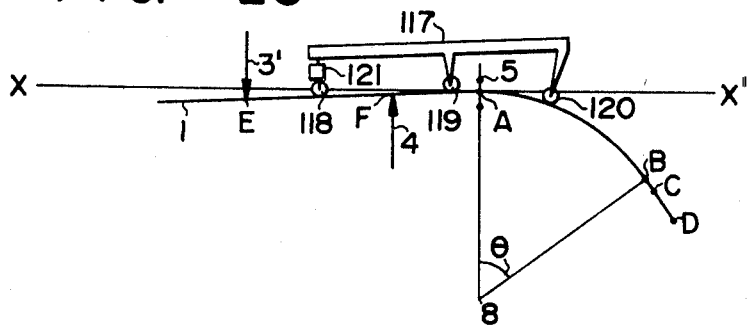
Figure 29:
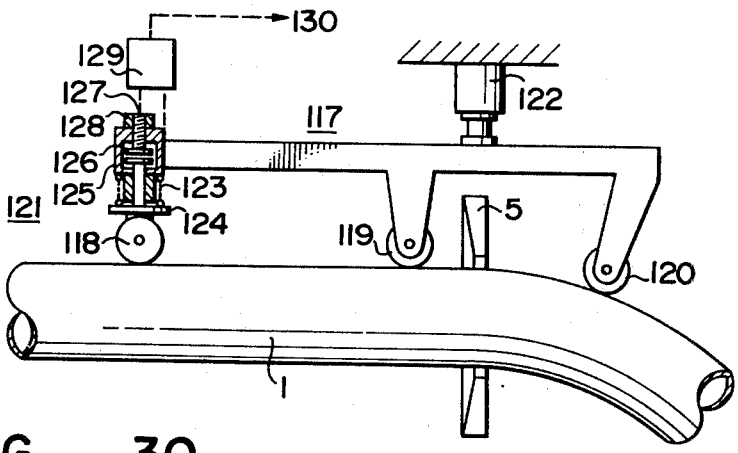
Figure 34:
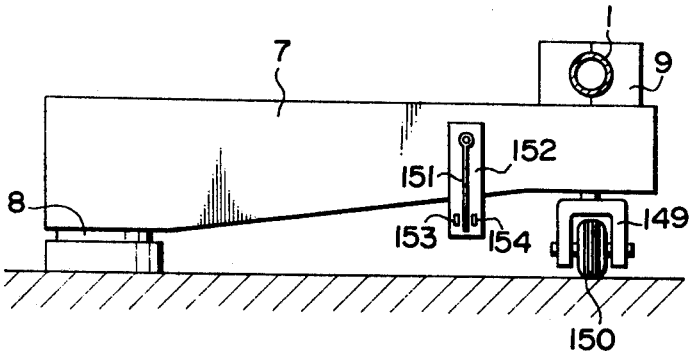
Figure 35:
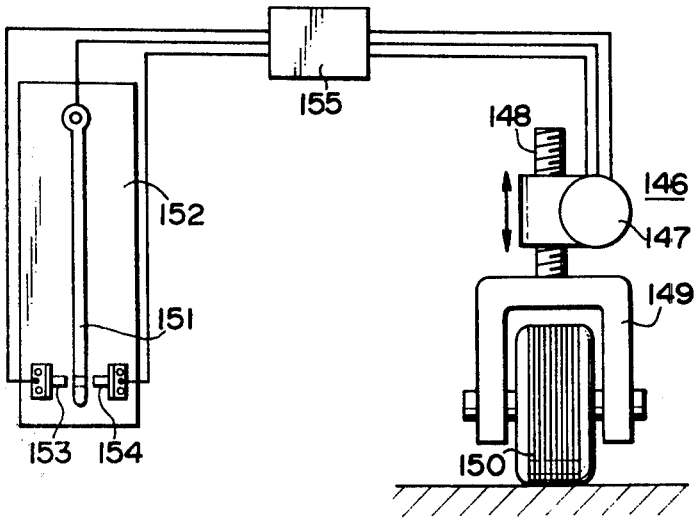

FIGS. 11*a*–11*e* illustrate the deflection or flexure that could take place in use of the apparatus of FIG. 1;

FIG. 12 is a plan view of a third embodiment according to the present invention for practicing bending of a metal pipe without inducing deflection such as shown in FIGS. 11*a*–11*c*;

FIG. 13 is a section in elevation taken on the line II—II of FIG. 12;

FIG. 14 is a chart showing a comparison of R flow seen in the steel pipes worked under the same conditions by using the apparatus of FIG. 1 and the apparatus of FIG. 12, respectively;

FIG. 15 is a plan view of a fourth embodiment according to the present invention for bending a steel pipe without giving rise to deflection or flexure such as shown in FIGS. 11*a*–11*c* with the apparatus being here shown in a condition just before start of the work;

FIG. 16 is a front view of the apparatus shown in FIG. 15;

FIG. 17 is a plan view of a condition where the bent portion of a steel pipe has been clamped to an auxiliary arm during the bending of the steel pipe by the apparatus of FIG. 14;

FIG. 18 is a sectional view taken on the line III—III of FIG. 17;

FIG. 19 is a chart comparing flexure seen in the steel pipes worked under the same conditions by using the apparatus of FIG. 1 and the apparatus of FIG. 15, respectively;

FIG. 20 is a plan view of a fifth embodiment according to the present invention;

FIG. 21 is a front elevation in partial section of the apparatus shown in FIG. 20;

FIG. 22 is a drawing for illustrating the principles of the apparatus of FIG. 20;

FIG. 23 is a plan view of a modification of the apparatus shown in FIG. 20;

FIG. 24 is a plan view of the apparatus of FIG. 23 which has been remodeled to be transportable and is here shown carried on the bed of a truck;

FIG. 25 is a schematic illustration of a conventional method;

FIGS. 26 to 28 are schematic illustrations of the method according to the present invention;

FIG. 29 is a plan view of a curvature change detector used in the method of the present invention;

FIGS. 30 to 33 are additional schematic illustrations of the method of the present invention;

FIG. 34 is a front elevational view of an arm in the apparatus according to the present invention provided with means for maintaining the horizontal position of the arm; and, FIG. 35 is a schematic electric circuit diagram for said apparatus.

THE DETAILED DESCRIPTION

Referring first to FIG. 1, there is shown a conventional apparatus which serves as the basis of the present invention. In the figure, reference numeral 1 designates a steel pipe to be bent, 2 a support block adapted to support the pipe end and formed integral with the means for continuously and straightforwardly propelling the steel pipe 1, 3 and 4 a pair of guide rolls, 5 a heating device such as an annular high frequency inductor which is capable of heating a limited area of the steel pipe 1 sidewise to a high temperature, 6 a cooling device integral with said heating device, 7 a rocker arm, 8 the pivotal shaft of the arm 7 arranged such that its center resides within the plane of the heating device 5, and 9 a clamp fixed to the arm 7.

In operation of the apparatus just described, steel pipe 1 is first passed between guide rolls 3 and 4 and then further passed through heating device 5 as shown in the drawing. The pipe end is supported by support block 2 of the propelling means, and in certain applications, the end or a suitable middle portion of the steel pipe 1 is fastened to the arm 7 by the clamp 9. The steel pipe 1 is continuously fed straightforwardly by the propelling means while subjected to local heating by heating device 5 to a plastic deformation inducing temperature, and this treatment is immediately followed by cooling so as to effect continuous plastic deformation of the steel pipe 1 in its heated area while giving a bending moment to the pipe 1 by the thrust of the propelling means under the guidance of the arm 7, thereby to accomplish the desired bending. Thus, according to this apparatus, the desired bending of steel pipe can be performed at high efficiency without requiring any elaborate thermal works. The same effect can be obtained by using this apparatus for bending of other types of metal pipes or metal strips. It is to be particularly noted that no bending mold is required and it is possible to bend the pipe at any desired radius of curvature.

However, when the above-said apparatus is used for bending metal pipes, there may take place, in certain cases, an undesirable phenomenon such as flattening, flexing, buckling or R flow.

When bending is carried out on a metal pipe by using the apparatus shown in FIG. 1, a certain degree of flattening is inevitably caused in the metal pipe depending on the size of the heated area and temperature applied. In order to prevent such flattening, the following measure proves effective, that is, a load equal to the breaking load is given to the portion of the pipe near its high temperature plastic area from the direction vertical to the breaking direction immediately after heating and cooling in the apparatus shown in FIG. 1, and then the high temperature plastic area of the bent pipe which has completed its plastic deformation is further plastically deformed to the perfect round shape or a slightly reversely flattened configuration, and then a suitable number of clamps 20 are attached externally to the pipe to thereby prevent sectional deformation of the pipe.

Figure 2:
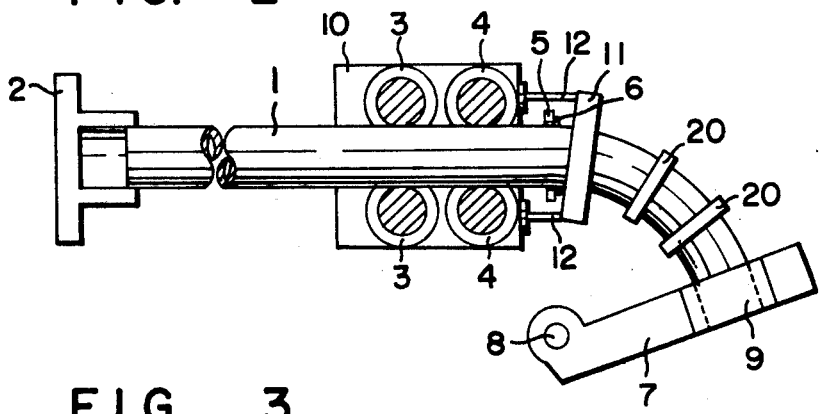
FIG. 2 is a plan view of an embodiment of the present invention for bending a metal pipe while preventing the flattening of the pipe.
Figure 3:
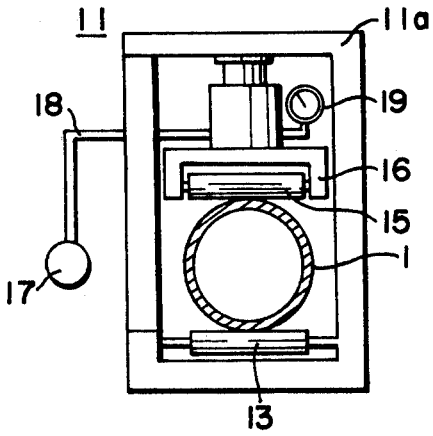
FIG. 3 is a front view in elevation of the embodiment shown in FIG. 2.
Figure 4:
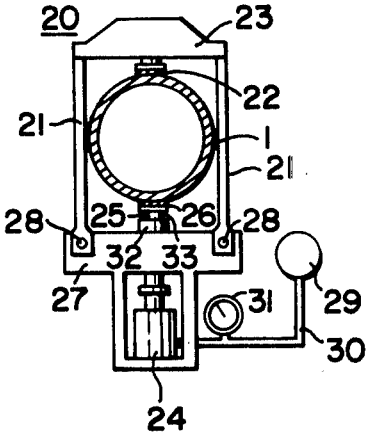
FIG. 4 is a front view in elevation of the embodiment shown in FIG. 2.

Shown in FIGS. 2 to 4 is an example of the apparatus which incorporates these arrangements. In the figures, numeral 10 indicates machine frame and 11 a pressing device detachably mounted in the machine frame 10 through a mounting member 12 so that the pressing device 11 is positioned on the clamp side of the cooling device 6 for preventing deformation of the steel pipe 1. A roll 13 is pivotally mounted at the lower part of the frame 11*a* of the pressing device 11 while a hydraulic jack 14 is mounted at the upper part of the frame, and bearing 16 carrying a roll 15 is provided in operative association with the hydraulic jack 14. The hydraulic jack 14 is connected to a hydraulic pump 17 by a hose 18.

Steel pipe 1 is inserted between the rolls 13 and 15 so that the pipe, which has been heated and cooled by the heating device 5 and the cooling device 6, is pressed from the direction perpendicular to the breaking direction. For applying pressure, a hydraulic pump 17 is operated to operate the hydraulic jack 14 to lower bearing 16. The pressing force applied can be known from reading the indication on a hydraulic gauge 19.

Numeral 20 indicates intermediate clamps disposed at suitable intervals along the portion of the steel pipe 1 which has passed the pressing device 11. As shown in FIG. 4, each of the clamps 20 consists of an upper cover portion 23 provided with integral support bars 21, 21 having secured to the center of its underside an indentation preventive member 22, and a lower cover portion 27 provided at its bottom with a hydraulic jack 24 of which the rod 25 projects out from its upper surface and carries at its end an indentation preventive member 26. The upper cover portion 23 is lowered down from above the steel pipe 1 so that the indentation preventive member 22 abuts against the upper surface of steel pipe 1, while the lower cover portion 27 is secured to the support bars 21, 21 by pins 28 from below the pipe 1.

Pressured oil is supplied into the hydraulic jack 24 from hydraulic pump 29 through hose 30 to raise up the jack rod 25, thus applying pressure while placing the indentation preventive member 26 against the underside of the steel pipe 1. The pressure applied is read from the hydraulic gauge 31, and when the required pressure has been reached, the rod 25 is locked by the nut 32. For this purpose, a thread 33 is provided at the upper portion of the rod 25, with the nut 32 being beforehand threadedly fitted thereon.

In operation of the just described apparatus, pressure device 11 is initially left demounted from the machine frame 10, and steel pipe 1 is passed between guide rolls 3 and 4 and then further passed through heating device 5 and fastened to arm 7 by means of clamp 9. Said steel pipe 1, while continuously and straightforwardly driven by propelling means, is heated by heating device 5 and then cooled by cooling device 6 to a predetermined temperature to undergo bending under the guidance of the arm 7. Then the pressure device 11 is set in position in the machine frame 10 so that the portion of steel pipe near its high temperature plastic area is passed between rolls 13 and 15 os the pressure device, and the hydraulic jack 14 is operated to apply pressure to the steel pipe from the direction vertical to the breaking direction thereof to effectuate perfect plastic deformation. Then, intermediate clamps 20 are fitted in position successively at suitable intervals in the axial direction to prevent the steel pipe 1 from being flattened due to lack of strength of the bent portion by thrust load, thereby accomplishing desired bending of the steel pipe 1 under the guidance of the turning arm 7.

Figure 5:
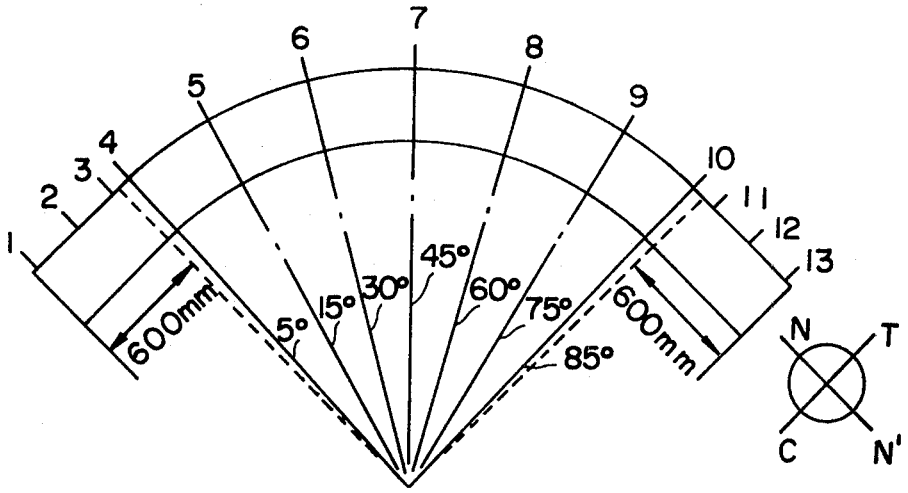
FIG. 5 is a chart and a table of numerical values showing a comparison of flattening of steel pipes which have been subjected to bending under the same working conditions by using the apparatus of FIG. 1 and the apparatus of FIG. 2, respectively.

As shown in FIG. 5, in a comparative test, a high tension steel pipe (API $5_{LX\text{-}X}60$) with diameter of 609 mm and thickness of 14.3 mm was subjected to bending under the hereinbelow specified conditions by using the above-described apparatus, while the same steel pipe was also subjected to bending under the same conditions except for non-use of pressing device and intermediate clamps by using the apparatus shown in FIG. 1. The sections of the portions shown in FIG. 5 of the thus bent steel pipes were measured, with the results thereof being shown in the attached table. It is noted that the steel pipe bent by the apparatus of the present invention, as compared with that bent by the apparatus of FIG. 1, is close to perfect in roundness in sectional shape and is free of spring back after work and also improved in precision of bending angle. Working conditions:

| | |
|---|---|
| Bending radius R: | 1827 mm |
| Bending angle: | 90° |
| Feed rate: | 0.3 mm/sec. |
| Heating temperature: | 970° C = 20° C |
| Cooling rate: | 2° C/sec. |
| Pressure applied by pressing device: | 10 tons |
| Pressure applied by intermediate clamps: | 9 tons |

Substantially similar effects are obtained by using the pressing device of FIG. 3 alone or by using the intermediate clamps of FIG. 4 alone.

Figure 6:
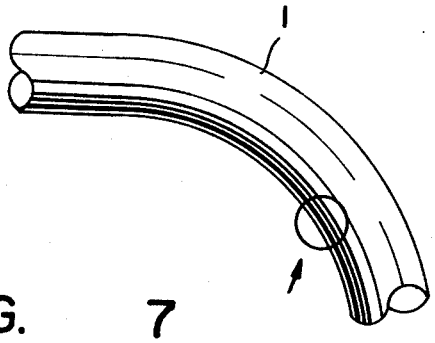
FIG. 6 is a drawing showing the flexing phenomenon which takes place during bending by the apparatus of FIG. 1.
Figure 7:
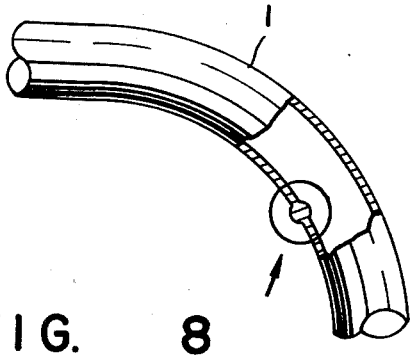
FIG. 7 is a drawing showing the buckling phenomenon which takes place in the same working.

When bending is performed on a metal pipe by using the apparatus shown in FIG. 1, it is sometimes experienced that deflection or flexure such as shown in FIG. 6 or buckling such as shown in FIG. 7 takes place in the initially bent portion of the pipe. These phenomena are ascribed to the fact that heating of the pipe is started with the pipe being kept in a stationary state in the early phase of bending so that the area to be heated tends to widen and overheat, resulting in sharp variation of distribution of plasticity in the pipe. The smaller the bending radius is, the more aggressive becomes this phenomena.

To prevent these phenomena, the following measures must be taken. That is, clamp 9 in the apparatus shown in FIG. 1 is double-structured, and a group of clamps arranged such that the inside clamps holding the metal pipe are slidable relative to the outside clamps are provided on the guide arm to fasten the metal pipe 1 by the clamps, and in the early stage of bending, the inside clamps are slided a suitable distance within the outside clamps in the pipe feeding direction at a rate lower than the pipe feed rate, with the metal pipe being kept held by the inside clamps to prevent slippage of the pipe, thereby to enlarge the radius of curvature during the early period of bending to allow smooth bending.

Figure 8:
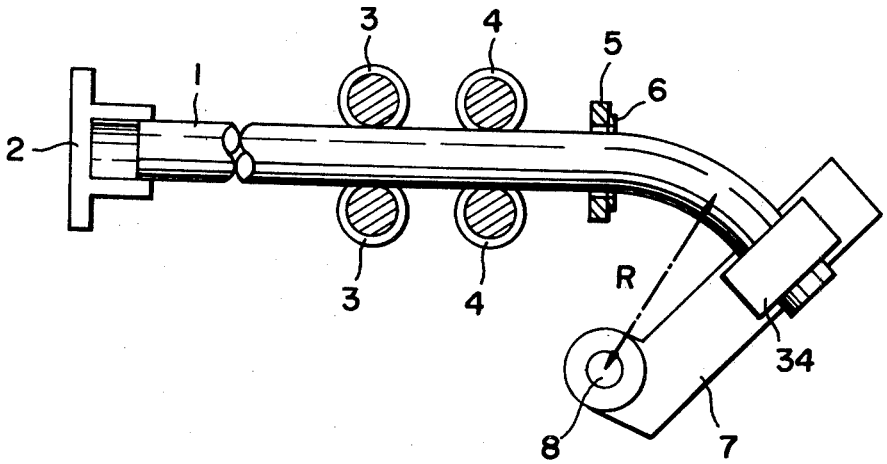
FIG. 8 is a plan view of another embodiment according to the present invention for bending a metal pipe without causing flexing and buckling in the pipe.
Figure 9:
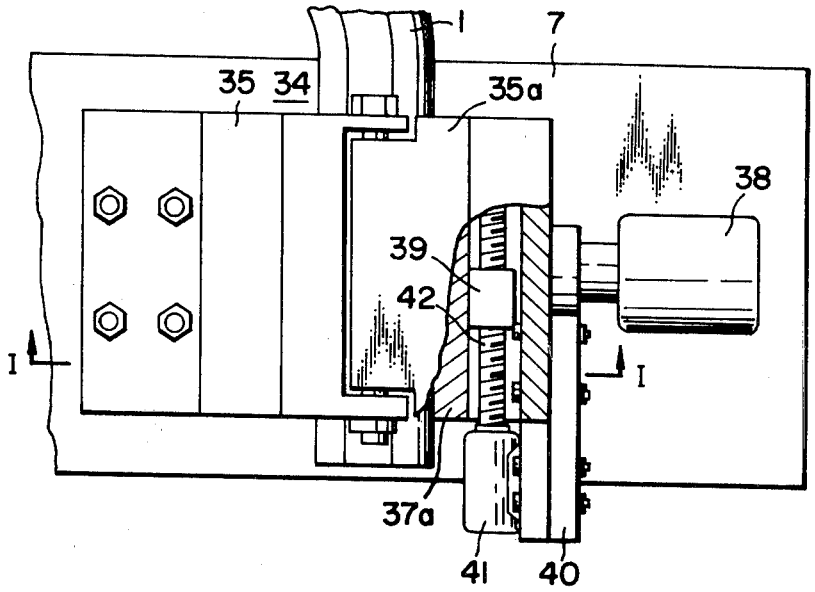
FIG. 9 is a plan view in partial section of the apparatus of FIG. 8.
Figure 10:
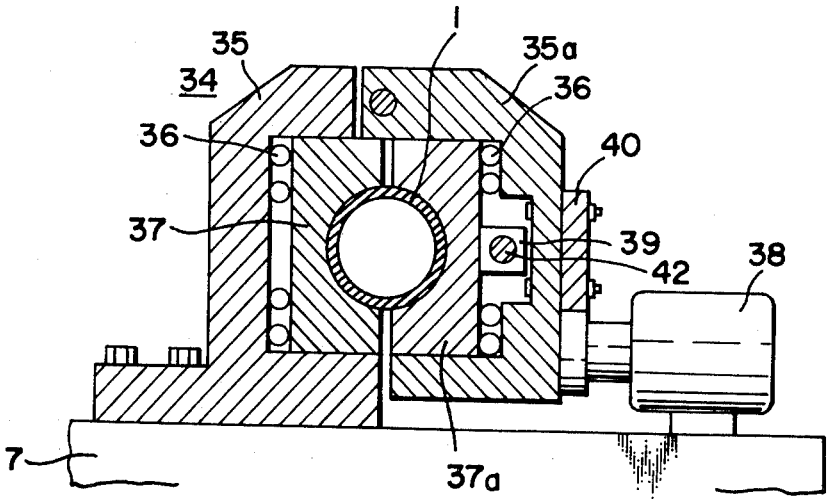
FIG. 10 is a section in elevation taken on the line I—I of FIG. 9.

Shown in FIGS. 8 to 10 is a device which incorporates such means. In the figures, numeral 34 designates a clamp assembly mounted at the end of arm 7 and comprising outside clamps 35, 35*a* which are free to open and close and inside clamps 37, 37*a* mounted slidable in said outside clamps through ball bearings 36. The outside clamp 35 is fixed to arm 7, and the leading end of the steel pipe 1 is disposed between inside clamps 37, 37*a* by opening the outside clamp 35*a*. Outside clamp 35*a* is pressed by cylinder 38 mounted on arm 7 to clamp the leading end of the steel pipe 1. On the other hand, the nut 39 is provided integral with the inside clamp 37*a* while the hydraulic motor 41 is connected to the outside clamp 35*a* through a fixing plate 40, and a threaded rod 42 secured to the output shaft of the motor 41 is threadedly engaged with said nut 39 so that when the hydraulic motor 41 is driven, the inside clamps 37, 37*a* are slidable in the outside clamps 35, 35*a*.

In operation of the device, the steel pipe 1 is passed between guide rolls 3 and 4 and then further passed through the heating device 5 and fastened by clamp means 34 to perform bending in the same way as the apparatus of FIG. 1. In the early phase of bending, the hydraulic motor 41 is driven to let the inside clamps 37, 37*a* slide in the outside clamps 35, 35*a* in the pipe feeding direction at a rate slower than the pipe feed rate while holding the pipe by the inside clamps 37, 37*a* so as to prevent the steel pipe from being deflected or buckled by the influence of sharp stress. After the inside clamps 37, 37*a* have slidingly moved a necessary distance, the hydraulic motor 41 is stopped and the steel pipe 1 is clamped by the entirety of the clamp means 34 to effectuate bending of the pipe 1 in the same manner as the apparatus of FIG. 1. The rate at which inside clamps 37, 37*a* are moved in the pipe feeding direction in the early stage of bending is selected to be slower than the pipe feed rate, usually about ½ of the pipe feed rate. The distance of sliding movement of the inside clamps 37, 37*a*, although varied depending on the size of steel pipe 1 and its bending radius, is usually from about 20 to about 25 mm.

On the other hand, when a metal pipe is subjected to bending by using the apparatus shown in FIG. 1 in the manner described above, there may take place a phenomenon of "R flow" in the pipe to cause fluctuation of dimensional precision after bending. As the bending angle is gradually enlarged, the length of the bent portion of the pipe increases while the rigidity of the portion is reduced to cause elastic deformation by thrust load which is a pipe propelling force, with the result that curvature of the pipe is changed to produce a deviation in the bending radius. This phenomenon of "R flow" begins to present itself, although slight at first, at a point where the bending angle reaches or slightly passes about 45°, and becomes conspicuous when the angle exceeds 90°. Flexure is directed outwardly in the early stage of bending but directed inwardly when the flexure exceeds a certain angle. The amount of the flexure varies depending on rigidity and length of the bent pipe portion, the working temperature and the bending radius. Particularly in the bending of a thin walled pipe, the bent portion flexes extending over the elastic deformation area, and this may finally cause plastic deformation.

Thus, when the bending angle of metal pipe changes from $\theta_1$ to $\theta_2$ and then to $\theta_3$ as shown in FIGS. 11(*a*), (*b*)

and (c) with the advance of work, the length BL between the heated point B and the end L of said pipe increases, that is, the length of the bent portion of the pipe varies in proportion to the bending angle. As the length BL of the bent portion increases, its rigidity lowers and the thrust load P, i.e., the pipe propelling force, produces flexure in the bent portion BL. When the bending angle exceeds 90 degrees, the component of force acting to produce flexure in the bent portion BL increases to induce elastic deformation in the portion BL, causing a positional shift $\Delta\phi$ from the correct arc BAL and a reduction of curvature at the point B, thus making it hard to obtain products with the correct bending radius. It is experimentally ascertained that this "R flow" begins to show at a point where the bending angle reaches or slightly passes 45°.

Such R flow can be prevented by regulating horizontal flexure in the bent pipe portion by one roll positioned outside of the bend or two rolls positioned both inside and outside of the bend so as to hold the bent pipe portion at a suitable position of bending angle where R flow scarcely occurs. Even better result can be obtained if the bending is practiced while regulating the flattening, which might otherwise occur in the bent portion by the action of the roll or rolls, by means of two additional rolls adapted to hold the bent pipe portion.

The device shown in FIGS. 12 and 13 comprises such improvements. In the figures, numeral 43 designates a roll stand, 44 its frame, 45 a slide base of the frame 44, 46 a nut provided in the base 44, 47 a threaded rod engaged with the nut 46, and 48 a motor for rotating the threaded rod 47. When the motor 48 is driven, the roll stand 43 slides forwardly or rearwardly and side rolls 49 and 49′ are adapted to horizontally embrace the bent portion of the steel pipe 1 and rolls 50 and 50′ are adapted to vertically press the bent portion of the pipe 1.

The rolls 50, 50′ are rotatably pivoted by bearing 51 which is slidably housed in a case 52 provided in the frame 44 and is arranged to be movable in the case 52 together with the rolls 50, 50′ by turning an adjusting screw 53. Side roll 49 is rotatably pivoted by bearing 54 and slidably housed in a case 59 mounted on a link arm 58 pivoted to the end of a rod 56 of the hydraulic cylinder 55 mounted in frame 11 and to hinge 57 provided in the frame 44. The bearing 54 can be moved in the case 59 together with the side roll 49 by turning an adjusting screw 60. Another side roll 49′ is rotatably pivoted by bearing 51 which is slidably housed in a case 62 provided in frame 44 and is connected by pin 64 to a load converter 63 joined to the case 62 so that the bearing 61 is movable in the case 62 together with the side roll 49′ by operating an adjusting screw 65. The load converter 63 is associated with the motor 48 which is arranged such that it is stopped when the side roll 49′ contacts the steel pipe 1 under the setting pressure when setting the roll stand 43 as hereinafter described. Bevel gears 66 and 67 are fixedly mounted at the ends of the adjusting screws 53 and adapted to transmit the driving force of the motor 70 to the respective adjusting screws 53 through respective power transmission mechanisms 68, 69 to move the rolls 50, 50′ up and down.

When bending steel pipe 1 by using the above-described apparatus, the roll stand 43 is set at a position as far away from the heating device 5 as possible within the range where no flexure develops in the bent pipe portion during bending of the steel pipe 1. Then the frame 44 is moved back so as not to hinder movement of arm 7 and the hydraulic cylinder 55 is driven to open side roll 49, followed by initiation of the bending of the steel pipe 1 in the same way as the apparatus of FIG. 1.

As the work advances and arm 7 passes the set position of roll stand 43, motor 48 is driven to let the roll stand 43 advance until the side roll 49′ comes to contact the outside of the bent portion of steel pipe 1 under proper pressure. When the roll stand 43 stops by the action of load converter 63, the hydraulic cylinder 55 is driven to close the side roll 49 while adjusting screw 60 is operated to let the roll 49 contact the inside of the bent pipe portion. The motor 70 is also driven to press the rolls 50, 50′ vertically against said bent portion by means of adjusting screw 53.

If bending is carried on under this condition, even if there arises a tendency to produce outward flexure in the bent portion of steel pipe 1 with enlargement of bending angle, such tendency is checked by side roll 49′ to nip out any possibility of creating flexure. Also, any tendency to produce flattening in said bent pipe portion by the action of side roll 49′ is suppressed by rolls 50, 50′ pressed vertically against the bent portion of the pipe. If bending advances in this way until the bending angle exceeds a certain value, there now arises a tendency to produce inward flexure in the bent pipe portion, but such tendency is checked by the side roll 49. Flattening is also prevented by rolls 50, 50′ in the way mentioned before. In this way, the bending of the steel pipe 1 can be accomplished free of flexure or flattening.

In fact, when bending was performed on 3-inch SGP steel pipe with bending radius of 1200 mm and bending angle of 120 degrees by using the above-described apparatus of the present invention and the apparatus of FIG. 1, the results showed that considerable flexure was produced in the pipe bent by the apparatus of FIG. 1 while almost no flexure was seen in the pipe worked by the apparatus of the present invention as shown in FIG. 14.

Thus, the apparatus of the present invention is capable of bending metal pipes without giving rise to the R flow phenomenon. It is also advisable to rotatably mount a rigid auxiliary arm on the pivotal shaft 8 of the arm 7 such that, during the bending work, when there has been achieved a suitable bending angle at which flexure scarcely occurs in the bent portion of metal pipe, the end of the auxiliary arm is clamped to the bent portion of the pipe at the position of the angle to thereby regulate flexure which could otherwise be produced in the bent portion.

With reference to FIGS. 15 to 18, a shaft 71 is mounted with means (not shown) for detecting the angle of turn of arm 7 (i.e., the bending angle of the steel pipe 1) and sending an electric signal. A bracket 72 is pivotally secured to the shaft through a boss 73 and a stretchable auxiliary arm 74 is secured to the bracket 72. The auxiliary arm 74 is of a hydraulic cylinder type and consists of a body portion 75, a first-stage arm portion 76, and a second-stage arm portion 77 carrying at its end a clamp device 78 can be seen in the drawings.

Thus, when oil under pressure is fed into the inside of the body portion 75 from its outer end, the first-stage arm 76 is pushed out. When the arm 76 reaches the end of its stroke, a limit switch (not shown) is actuated to feed oil under pressure into the first-stage arm 76 to push out the second-stage arm 77. Clamp means 78 consists of a fixed clamp 79 and an opening-closing clamp 80, the latter being mounted through a hydraulic cylinder 82 to a frame 81 hinged to the fixed clamp 79, and opening and closing of the clamp 80 is accomplished by the operation of the fixed clamp 79 and a hydraulic cylinder 83 provided in the frame 81.

A limit switch 84 is disposed on said fixed clamp 79. If this limit switch 84 is actuated when the clamp 80 is open, the hydraulic cylinder 83 is operated to close the clamp 80. The auxiliary arm 74 and clamp device 78 are controlled by a hydraulic circuit as so is the means for detecting the angle of turn of arm 7 (that is, the bending angle of steel pipe 1) and issuing an electric signal.

When bending work is practiced on steel pipe 1 by using the above-described apparatus, first the proper bending angle at which flexure hardly occurs in the bent portion of said pipe is obtained empirically, and this angle and the desired bending angle are set in the bending angle detecting means provided on shaft 71 of arm 7 such that when the bending angle of steel pipe 1 has reached either of the set angles, the means detects it and issues an electric signal to actuate the auxiliary arm 74 and clamp means 78. Then, bending work is carried out in the same way as the apparatus of FIG. 1, and when there has been achieved the preset bending angle at which substantially no flexure occurs in the bent portion of pipe 1, the detecting means provided on shaft 71 detects such angle and gives out an electric signal, whereupon oil under pressure is fed into the body portion 75 of the auxiliary arm 74 from its outer end to push out the first-stage arm 76.

If clamp means 78 does not reach steel pipe 1 even when the first-stage arm 76 reaches its stroke end, the second-stage arm 77 is pushed out until the limit switch 84 provided on fixed clamp 79 of clamp means 78 in the open state touches the steel pipe 1, whereupon hydraulic cylinder 83 is operated to turn frame 81. Thus when clamp 80 is closed and opposed to fixed clamp 79, hydraulic cylinder 82 is now operated to fasten steel pipe 1 by both clamps 79, 80.

If bending work is carried on under this condition, even if there should arise a tendency to produce flexure in the bent portion of pipe 1, such tendency is retarded by auxiliary arm 74 to allow smooth advancement to the desired angle without producing any flexure. When the desired angle is reached, the detecting means detects it and issues an electric signal, whereupon the pipe propelling means as well as the heating device 5 and cooling device 6 are shut down to complete the bending work while the bent steel pipe 1 is released from the clamp means 78.

Although only one auxiliary arm 74 is used in the foregoing embodiment, it is possible to use two or more such arms.

For the sake of comparison, bending work was conducted on 3-inch SGP steel pipes with bending radius of 1200 mm and bending angle of 120° by using the above-described apparatus and the apparatus of FIG. 1. It was found that, as shown in FIG. 19, R flow was produced to a considerable extent in the pipe bent by the apparatus of FIG. 1 whereas almost no R flow was seen in the pipe bent by the above-described apparatus of the present invention.

The device shown in FIGS. 20 to 24 is a metal strip bending apparatus which employs the technical conception of the apparatus of FIG. 1. This apparatus comprises an annular heating device which heats to a high temperature a narrow area on the outer peripheral surface of a metal pipe or other metal strip to be bent and an annular cooling device. A bearer adapted to hold the fore end of the pipe or the like is provided on the swingable arm 7 arranged such that the pivotal shaft 87 thereof is located within the plane of the annular heating device, while another bearer adapted to hold the rear end of the pipe is provided on another arm. A traction means using screw, cable, chain or hydraulic means is disposed between a point on the arm at a distance substantially the length of bending radius away from the center of the pipe and a point of the arm shaft support at a distance substantially the length of bending radius away from the center of the pipe.

Now with reference to FIG. 22, A is a point at which bending of pipe 1 is started, B is the rear end of pipe 1, C is the fore end of pipe 1, D is a point which may be coincident with point B or may be positioned slightly therebehind, E is a point on pipe 1 positioned close to point A when bending starts, O is the center of bend, and H is annular heating device attached with cooling device. This annular heating device may be substantially identical with heating device 5 in the apparatus of FIG. 1 and arranged around point A. S is an arm forming a triangle OEC and adapted to regulate movement of the fore end of pipe 1, and T is an arm forming a triangle $O'_{BD}$ and adapted to fix the rear end of pipe 1. Heating device H is arranged to heat a narrow area on pipe 1, and the heated area is immediately cooled. Arm S is swingable about the point O, and the segment O—O' connecting the ends O and O' of respective arms S and T is parallel to the center line X—X of pipe 1 before the bending moment is applied thereto. Thus, when mutually pulling forces are acted between the ends O and O' of said arms S and T while heating the pipe 1 by heating device H, with the distance X—X being equalized to the bending radius, the pipe 1 is bent. In other words, the pulling forces acting between the points O and O' before heating is started at point A causing the pipe 1 to be deformed as shown by bold line BAE in FIG. 11(*a*).

Here, if it is assumed that the pulling force acting between points O and O' is P, the bending radius is R and bending moment produced at point A is M, then the following relation exists always:

$$M = PR \tag{1}$$

Therefore, if heating temperature at point A is kept constant, M also becomes constant, so that bending can be continued by advancing the pipe 1 while keeping P constant. On the other hand, if it is assumed that the distance BB' of point B from the straight line X—X is $\delta$, this $\delta$ varies proportionally to the length BA, that is, it is gradually reduced as the length BA diminishes as shown in FIG. 11(*b*).

Therefore, it is usually necessary to change the length of arm T, that is, the length O'B in accordance with advancement of bending, and to make curve BA contact the line X—X at point A, but according to the present invention, since work is carried out by performing local heating at point A, the bending moment applied to the pipe 1 is extremely small, and hence flexure at the pipe end B is extremely small as compared with the pipe length AB. For instance, in the case of a pipe with outer diameter of 165.2 mm, thickness of 5 mm and length of 5.5 mm, flexure that develops at the pipe end B in the bending work is merely about 5 cm, which is less than 1 percent of the pipe length AB and hence almost negligible.

Therefore, desired bending can be accomplished if the apparatus is constructed so as to satisfy the above-said conditions, but for performing high precision bending work where no flexure is allowed, the following measure is taken. That is, since the moment produced in the pipe is substantially uniform and constant, that is, M is substantially equal to PR as said above, and the curve BA becomes an arc of the circle having a constant radius of curvature $\rho$, it is only required to make control such that the center point B of the pipe end moves on the arc of the circle. By so doing, the curve BA is always in contact with the line X—X and hence it becomes possible to maintain the bending radius R constant while substantially excluding flexure at the pipe end.

Shown in FIGS. 20 and 21 is an example of apparatus which incorporates the above-described principles. In the figures, numeral 85 designates the rolls carrying the steel pipe 1 which are adjustable in height, 86 a support which supports the arm shaft 8, and 87 a pulley disposed at an upper part of the support 86 and concentric with the axis of rotation O—O of the arm 7 or centered nearby. The lower part of the support 86 terminates in a bearing for the shaft 8 and the upper part terminates in a bearing for the pulley 87. An arm 88 which is substantially same as the arm T shown in FIG. 22, a base 89 mounted on the arm 88, a boss 90 mounted on base 89 so as to be turnable through a small angle by a shaft 91, and a core 92 supported integrally with the boss 90 are also provided.

The fore end portion of the core 92 is loosely fitted into the steel pipe 1 while the rear end portion is formed equal in diameter to the steel pipe 1 so that the end of the pipe 1 and the core 92 may be held together by a clamp 93. A support leg 94 of the arm 88, rollers 95 mounted in two sets of two on the support leg 94, a pulley 96 mounted on the arm 88 through the support 97, a winch 98 disposed on the arm 88, a cable 99 passed round the pulleys 87 and 96 so as to be wound up by the winch 98, and guide rails 100 and 101 for maintaining the arm 88 vertical or substantially vertical to the line X—X are provided. The guide rail 100 is so arranged that the rollers 95 of the support leg 94 will hold the rail, while another guide rail 101 is arranged to guide the roller 102 provided at the bottom of the mount of the winch 98. The arm 88 and support leg 94 are so mounted that they are turnable through a small angle with the pulleys 87 and 96 arranged so that the line connecting their mounting axes is parallel to the guide rails 100, 101 and positioned at a point distant the length of bending radius away from the center of the steel pipe 1. A high frequency transformer 103 for the heating device 5, a bolt 104 disposed rotatable at the fixed position on the arm 88 and threadedly passed through the base 89, a motor 105 having its shaft connected to the bolt 104, a detector 106 having rotatably mounted thereon a roller 107 lightly in contact with the steel pipe 1 positioned adjacent to detect displacement of the steel pipe 1 to issue a signal corresponding to such displacement, and an output converter device 108 for rotating motor 105 either forwardly or reversely according to the signal issued from the detector 106 are also provided. This converter is electrically connected to the motor 105 and the detector 106.

The core 92 is supported integrally with the rotatable boss 90 for allowing generation of sufficient bending moment without changing the tilt of arm 88 during the bending even if the fitting of the core 92 and steel pipe 1 is loosened. This support also allows for easy withdrawal of the core 92 from the steel pipe 1 by loosening the fit thereof by slightly turning the boss 90 reversely upon completion of the bending. The rear end of the steel pipe 1 may be clamped by the same clamp 9 as used for the front end, but use of the core 92 facilitates removal of the steel pipe 1 upon completion of the bending work and is also useful for preventing contact of the steel pipe 1 with the heating device 5.

According to the above-described apparatus, steel pipe 1 is moved at a constant speed by producing bending moment directly in the pipe by winding up the steel cable 99 by the winch 98 so that the pulling forces are acted directly between the pulleys 87 and 96 in a way to twist the pipe 1. In the meanwhile, steel pipe 1 is locally heated by heating device 5 so that bending occurs continuously in the heated portion of the pipe. These steps are sufficient for bending work of pipes for which normal degree of precision is required. For performing bending work where high precision is required, the control means 104 and older ones are used.

These control means are designed to keep the center of the boss mounting shaft 91 (corresponding to the pipe end B in FIG. 22) substantially on the arc of the circle BA so that even if the steel pipe 1 flexes, its center line stays in contact with the original center line X—X at the heating point A of heating device 5, thereby to maintain the bending radius R of the pipe 1 constant. Thus, if steel pipe 1 is displaced to push roller 107, detector 106 detects it and issues a positive signal to actuate motor 105 to rotate forwardly through output converter 108 to move the center of the boss mounting shaft 91 toward the line X—X through screw 104 so that roller 107 will not substantially be forced out from the set position. If steel pipe 1 attempts to separate from roller 107, the detector 106 detects it and issues a negative signal to perform adjustment just contrary to the above-said. Generally, the pipe advancing speed in bending work of pipes is slow and displacement such as above-mentioned takes place very slowly, so that very stabilized control can be accomplished by using the control means.

Shown in FIG. 23 is also a bending apparatus which is basically of the same construction as the apparatus shown in FIGS. 20 and 21. The difference is that the right ends of guide rails 100, 101 are supported by rotatable pin joints 109, 110 which are so arranged that the center of their rotation is present within the plane of heating device 5, that is, on the line CA in FIG. 22, while the left ends of guide rails 100, 101 are fixed to channel-shaped rails 111 by bolt nuts 112. The angle made by these guide rails 100, 101 and the original center line X—X of steel pipe 1 is adjusted to become equal to the angle $\phi/2$ which is made by the lines BA and X—X and wherein $\phi$ is the angle of $\angle$BNA where N is center of curvature of the arc BA in FIG. 22(*a*), whereby the amount of flexure at the center point of left end of steel pipe 1, that is, at point B in FIG. 22(*a*), is adjusted to become $\delta$, and then the bending is carried out.

In making the adjustment, both front and rear ends of steel pipe 1 are fixed to arms 7, 88 and, with bolt nuts 112, being kept loose, a predetermined amount of tension is applied between arms 7 and 88 by winch 98. The guide rails 100, 101 are tilted so that the angle made by steel pipe 1 and its original center line X—X will become $\phi/2$, which is followed by stoppage of said winch 98 and final fixing of bolt nuts 112. The values of $\phi$ and $\delta$ can be easily calculated by using a calculation formula of radius of curvature and flexure relating to the beams to which simple moment has been applied. Numeral 42 in the figure indicates support for guide rails 100, 101.

FIG. 24 shows still another modification in which arm 88 in the apparatus of FIG. 23 is split into two portions 88 and 88', connected to each other. It is to be also noted that roller 85 is arranged movable while the support 86 supporting the arm 7 is fixed on a disc 86'. This disc 86' is arranged pivotable 90° counterclockwise about the center 0 of the turn of the arm 7 to let the support 86 turn 90° counterclockwise from the direction shown in FIG. 23 and thus place it on the bed 114 of a truck or the like. Thus, if roller 85 is placed outside of and parallel to guide rail 100 while placing arm 88' inside of and parallel to guide rail 101, the arm 88' can be properly placed on the bed 114.

In the figure, the circular rails 115 and 116 rollably support receiving rolls (not shown) extending from arm 7 for preventing the support 86 and disc 86' from being loaded with the weight of arm 7. Although heating device 5 is not shown in FIG. 24, it may be fixed to a high frequency transformer and these means may be arranged movable by a suitable method and connected to the apparatus when the latter is used.

What is important in the three apparatuses shown in FIGS. 20 to 24 is that, since bending is started while applying a bending moment to steel pipe 1, it must be attempted to prevent formation of a bulge in the heated portion of the pipe either by driving the winch 98 immediately before plastic deformation takes place in the pipe 1 or by using double clamps such as shown in FIGS. 9 and 10.

In the bending apparatus such as shown in FIG. 1, the apparatus may be damaged if thrust is applied to steel pipe 1 before the heating temperature rises up sufficiently. However, in any of the above-described apparatus of the present invention, the portion where load is applied is limited to a very small area and it is easy to make such portion strong enough to withstand damage, so that any slight misoperation does not lead to damage to the apparatus. Also, the apparatus can be extremely reduced in weight and no solid fundamental work is required, so that the apparatus of the present invention, like the one shown in FIG. 24, can be transported. Use of such transportable apparatus can greatly facilitate bending work on steel pipes or the like in the work sites.

The above-described methods and apparatus can substantially eliminate the problems of the conventional methods and apparatus, but it is still unable to avoid the phenomenon of "R expansion" — a phenomenon that spring back is caused to expand the bending radius R after the bending has been completed. Therefore, it has been attempted heretofore to carry out the bending with a bending radius that makes allowance for possible spring back. This measure, however, is still unsatisfactory.

That is, according to the heretofore proposed apparatus, as shown in FIG. 25, a pipe 1 to be worked is passed between guide rolls 3, 3' and 4, 4' and then through heating device 5 and fastened to clamp 9 at the end of arm 7. Thus, the pipe 1, while moved forwards by thrust P, is heated locally by heating device 5 to a plastic deformation inducing temperature and then immediately cooled by cooling device, not shown, so as to induce continuous plastic deformation in said heated area of said pipe while giving bending moment thereto. The axis of the unbended pipe portion is rectilinear and also the position of the vertical line bending down from the center O of bend as well as the distance of shift of the heating point A from the axial line XX' is slightly changed by change of the bending angle $\theta$, that is, the length between the bending starting point B and heating point A, so that when clamp 9 is loosened to release the pipe upon completion of the bending work, the fastened portion, or the clamp portion CD, may not only spring back to the position of CoDo, but also the bending radius does not stay uniform with respect to the bending angle resulting in increased bending radius at the termination of bending.

Such problems can be overcome if the metal pipe to be worked is moved forwards while keeping it at a position where it has turned a slight angle from the point of intersection of the line connecting the center of bend and heating device and the line crossing the first line at right angles, or if the heating device is disposed at the position where it has turned a slight angle from the center of bend on the straight line in the direction of advancement of the metal pipe and with respect to the vertical line connecting the straight line and center of bend, thereby to confine the apparent spring back to zero. Further, if need be, means are provided for detecting the change of curvature of the metal pipe during the bending, and if such change is detected, the heating device is moved to keep the bending radius constant throughout the bending work. These arrangements can preclude the phenomenon of "R flow".

FIGS. 26 to 33 are drawings which illustrate these arrangements. With reference to these drawings, FIGS. 26 and 27 illustrate means for reducing to naught the spring back which has been present in the bending of the metal pipe according to a conventional method. According to the method of FIG. 26, the base portion of the pipe 1 is given a slight turn $\theta_2$ from the heating point A with respect to the axial line XX' so as to provide extra plastic deformation at the heating point A. Thus, even if spring back should take place as shown by dotted line after release of clamps, the entirety of the dotted line is turned through an angle of $\theta_2$ about the heating point A to let the base pipe portion coincide with the axial line XX', whereby the clamp portion CoDo comes to coincide with CD on the axial line of the clamp. According to this method, the bending radius after the bending work becomes equal to the radius R which is the radius when the pipe was set to the apparatus, and in consequence, apparent spring back is reduced to zero.

According to the method of FIG. 27, heating means 5 is turned a slight angle $\theta_2$ about the center of bend 8 and the heating point A. While kept in agreement with axial line XX', it is moved to point A', and the bending is performed with the base portion of the pipe 1 being in agreement with the axial line XX', thereby to expunge spring back after the work. To be more precise, OA' becomes slightly greater than OA, but as the angle $\theta_2$ is extremely small, the difference between OA' and OA may be ignored. For instance, in case of bending a pipe with outer diameter of 60.5 mm and thickness of 3.2 mm at the bending radius of 300 mm, if $\theta_2$ is set at 0.76°, spring back is reduced to zero, but the rate of change of the bending radius is given as follows:

$$\frac{(OA' - OA)}{OA} = \frac{\frac{1}{\cos\theta_2} - 1}{1} \approx 9 \times 10^{-5} \qquad (2)$$

That is, the rate of change is merely 0.03 mm when the radius is 300 mm. Also, the bending radius in the finished article can be made smaller than the original radius (that is, the radius of the pipe when set in the apparatus) by further shifting the heating point A from A' to the former position.

Thus, according to the methods shown in FIGS. 26 and 27, the apparent spring back in the finished article can be reduced to zero. Further, even if the load at each fulcrum varies with change of the bending angle, the bending radius in the finished article can be equalized to the original radius of the pipe as set in the apparatus (that is, the length of the line drawn from the center of bend 0 to the center line of clamp 9) by suitably controlling the value of the angle $\theta_2$ regardless of the bending angle $\theta$. For achieving this, there is required a curvature change detecting means for giving a signal to the control system.

With reference to FIG. 28, the numeral 117 designates generally the curvature change detecting means comprising contactors 118, 119 contacted with the base portion of the pipe 1, a contactor 120 contacted with the bent portion of the pipe, and a displacement detector 121 provided at the supporting portion of the contactor 118. Arrangement is made such that the contactor 118 contacts the base pipe portion at a position intermediate guide rolls 3' and 4 while the contactor 119 contacts said base portion at a position as close to heating means 5 as possible. On the other hand, contactor 120 is arranged to contact the bent portion of the pipe 1 at a location sufficiently distant from the heating point A so that change of curvature in the heating point A will present itself sufficiently as a displacement of the bent portion of pipe 1. The configuration of contact areas and contact pressure are suitably selected such that the contactors 118, 119, 120 will contact the outer wall of the pipe 1 strongly along as small an area as possible.

With particular reference to FIG. 29, the displacement detector 121 includes a hydraulic cylinder 122 for pressing the contactors 119, 120 against the pipe 1 at a constant strong pressure. A spring 123 for pressing the contactor 118 against the pipe 1 with a strong force, a spring stop 124 for securing an end of the spring 123, a flat plate 125 integral with the contactor 118 and another flat plate 126 fixed in the detector 121 in parallel to the plate 125 are provided. A screw 127 and a nut 128 for suitably adjusting and fixing the position of the flat plate 126, an oscillator 129 whereby the change of $\delta$ produced by the change of curvature during the bending of pipe 1 is converted into a control signal 130 are also provided.

Thus, when a change of curvature occurs during the bending and such change is detected by detector 121, a pertinent displacement is given to guide rolls 3', 4 in FIG. 26 to cause a change of the contact pressure at the acting points E and F of these rolls 3' and 4 to the pipe to change the angle $\theta_2$. That is, if the curvature is reduced and the radius enlarged, contact pressure of contactor 120 to the pipe 1 at that position is increased, and as a result, the curvature change detecting means 117 is turned slightly about contactor 119 by the action of cylinder 122 and the distance $\delta$ between the flat plate 125 secured to contactor 118 and the flat plate 126 secured to displacement detector 121 is reduced to change the signal 130 and $\theta$ is accordingly reduced. On the other hand, if the curvature is enlarged and the radius reduced, a displacement just contrary to the above-said one occurs to give a contrary signal to enlarge the angle $\theta_2$. There are available various types of methods for changing $\theta_2$, and some examples of such methods are hereinafter discussed.

Figure 30:
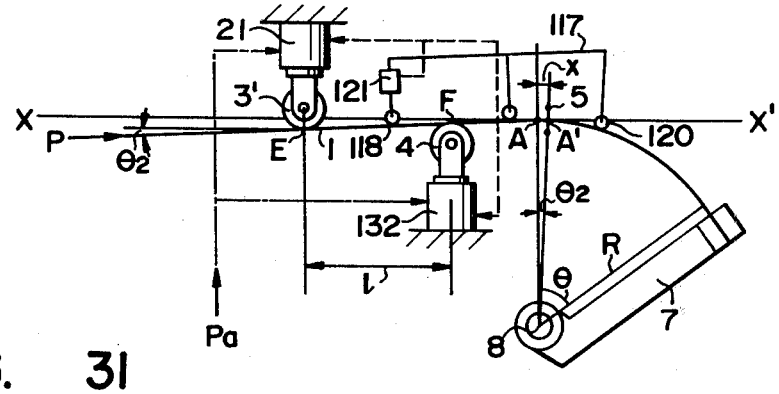

Guide rolls 3', 4 are displaced simultaneously in a first method. As shown in FIG. 30, numerals 131 and 132 designate hydraulic cylinders for supporting and, if need be, moving the guide rolls 3', 4. These hydraulic cylinders 131, 132 are of a same output and associated with a displacement detector 121. Guide rolls 3', 4 are supported by the hydraulic cylinders so that the guide rolls 3', 4 will act to provide the same load in the different directions at the acting points E, F so as to give a moment acting outwardly as seen from the center of bend 8 at the heating point A' and to leave no shearing force, that is, to form a bend of a simple moment.

Thus, hydraulic cylinders 131, 132 fix these means to the body portion of the apparatus and, if given a constant hydraulic pressure Pa, they operate to produce a uniform bending moment M during the time when they move from the guide rolls to the heating point A'.

$$M = wl \tag{3}$$

where $w$ is the output of each hydraulic cylinder; and, $l$ is the distance between the acting points E and F of guide rolls 3' and 4.

Therefore, the amount of $\theta_2$ can be varied by changing the hydraulic pressure in correspondence to the signal 130 from the detector 121.

The conventional apparatus are intrinsically capable of bending pipes with extremely high precision until the bending angle $\theta$ reaches about 45°. Therefore, within such range of bending angle, the bending can be carried out in the conventional way with no need of making any extra control works and keeping guide rolls 3, 3', 4, 4' fixed. When bending is started while keeping the guide rolls in agreement with the axial line XX', it is necessary to set the heating means 5 at a position where it has advanced the distance:

$$x_1 = R\epsilon \tag{4}$$

corresponding to the slight angle $\epsilon$ of turn of the arm 7 by the time the bend begins to appear. Also, for reducing spring back to zero, the position of heating means 5 must be further advanced the distance:

$$x_2 = R\theta_2 \tag{5}$$

which is equivalent to the slight angle $\theta_2$ of turn in FIG. 27. In detecting the bending angle, the slight turn of arm is not counted in the primitive stage.

Figure 31:
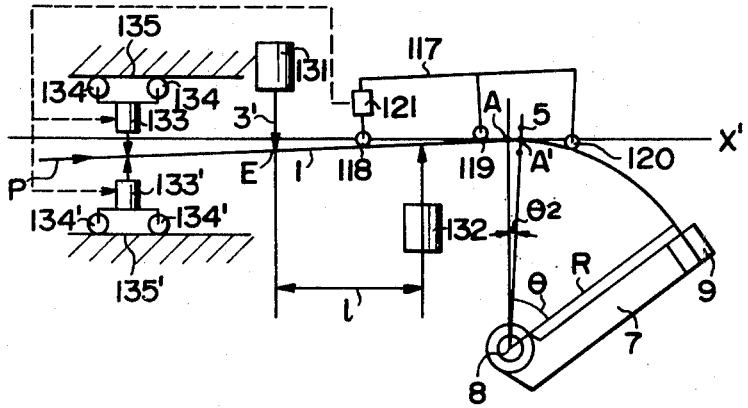

The guide rolls 3', 4 are arranged freely displaceable in a second method in which a constant load is applied and the angle of slant $\theta_2$ of the base portion of pipe is changed by displacement of the distal end of the portion. As shown in FIG. 31, 133 and 133' designate hydraulic cylinders in contact with the base portion of the pipe 1. They are mounted with rollers 134, 134' movable on guide rails 135, 135' provided on the body portion of the apparatus and are associated with displacement detector 121. Guide rolls 3', 4 are applied with a constant load $$W = Ma/l \tag{6}$$

where Ma is the bending moment sufficient to induce plastic deformation at a specified temperature in the pipe 1 at the heating point A'.

This can be accomplished the same way as in the first method, but the hydraulic pressure applied to hydraulic cylinders 131, 132 is kept constant. For controlling the angle of slant $\theta_2$, thrust P is applied to point G at the distal end of the pipe 1 while giving a suitable displacement by hydraulic cylinders 133, 133'. The angle of slant $\theta_2$ of the base portion is controlled by the signal from displacement detector 121.

This method is superior in stability to the above-described first method. This is because the first method involves the possibility that the resistance of the distal end of the pipe 1 which gives thrust could impair smoothness of control. Also, this second method ensures positive operation as hydraulic cylinders 133, 133' directly overcome the resistance of the distal end of the pipe 1 to allow very effective control.

It is to be also noted that as the point G advances in coincidence with bending, hydraulic cylinders 133, 133' are arranged movable parallel to the axial line XX' by means of rollers 134, 134' and guide rails 135, 135'.

Figure 32:
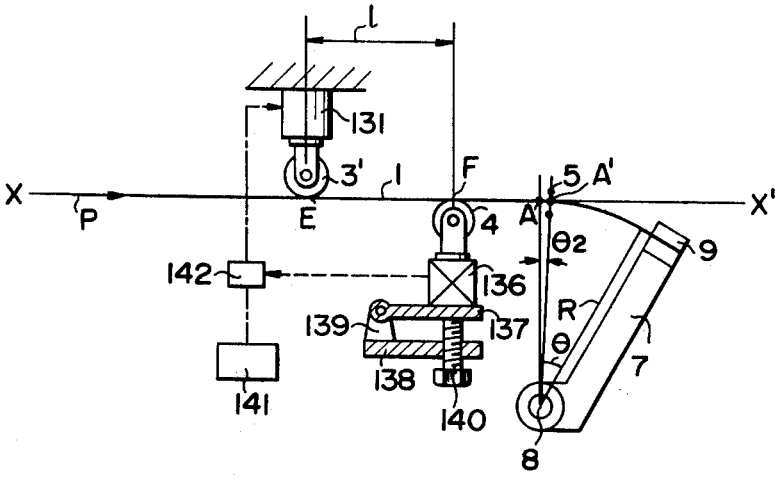

The guide roll 4 is fixed while the guide roll 3' is displaced by hydraulic cylinder 132 alone to change angle of inclination $\theta_2$ of the base portion of pipe in a third method. As shown in FIG. 32, numeral 136 designates a load gauge provided in attachment to the support portion of guide roll 4, and a swingable block 137 is pivotally secured to a support 139 provided on a pedestal 138. The swingable block 137 carries the load gauge 136 and is arranged to let the guide roll 4 lightly contact the pipe 1 by adjusting a screw 140. There are also provided a hydraulic pressure generator 141 and a hydraulic pressure adjuster 142, the latter being associated with said hydraulic cylinder 131 and load gauge 136 so that the load gauge 136 is operated by said hydraulic cylinder 131.

Thus, according to this method, guide roll 4 is not displaced but kept at the fixed position, and the oil pressure of the hydraulic cylinder 131 is adjusted to prevent R flow. It is possible with this method to prevent R flow but a slight error is produced in the bending radius R. Such error, however, is quite small, less than 0.8 mm when bending work is performd with bending radius of 200 mm, so that no trouble arises in practical applications. When for instance a bend of 180° is made, there takes place about 1 percent of R flow whereas the error is not more than about 0.3 percent.

Most important in this method is selection of the acting point of guide roll 4 and the method of hydraulic pressure adjustment of hydraulic cylinder 131. One of the recommendable ways for achieving this is described below.

Before starting the work, heating means 5 is set at a position where it has advanced a distance corresponding to the angle $\theta_2$ as shown in FIG. 26, and the heating point is selected at A'. Then the pipe 1 is set in position and screw 140 is adjusted so that guide roll 4 lightly contacts the pipe 1. In the meantime, hydraulic cylinder 131 is operated to let guide roll 3' lightly contact the pipe 1, and then the position of hydraulic cylinder 131 is fixed.

Under these conditions, heating of the point A' is started and thrust P is applied to start bending of the pipe. This bending is continued until the bending angle reaches about 30°. Here, hydraulic cylinder 131 is operatively associated with load gauge 136 and inclination of the base portion of the pipe is automatically adjusted by displacement of guide roll 3'. As the bending is carried on in this way, contact pressure Fp of guide roll against the pipe 1 is reduced and the difference between the pressure Fp and the contact pressure Ep of guide roll 3' against pipe 1 is increased, with said contact pressure Ep having the tendency to decrease. Then, automatic control is made such that the detected pressure of load gauge 136 becomes equal to the operating pressure of hydraulic cylinder 131 and that Ep becomes equal to Fp.

For achieving this, hydraulic pressure from hydraulic pressure generator 141 is adjusted in cooperation with hydraulic pressure adjuster 142 and load gauge 136 so that hydraulic cylinder 131 will produce a load equal to the detected load, whereby the contact pressure of guide rolls 3' and 4 against pipe 1 can be kept equal to each other in absolute value in the opposite directions. Consequently, shearing force at the heating point A' dies away and also elastic deformation in the bent portion of the pipe is diminished to substantially eliminate R flow. Thus, the desired bending can be accomplished with satisfactorily high precision for practical uses even if the curvature change detecting means 117 is not used.

Figure 33:
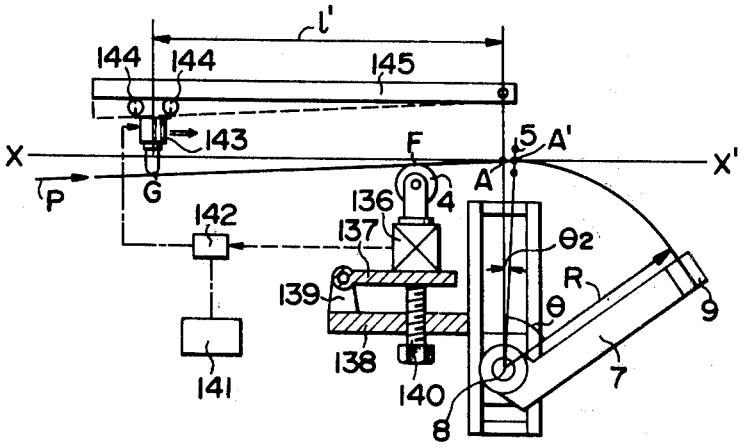

The guide roll 4 is fixed and loading pressure of guide roll 4 and operating pressure of hydraulic cylinder 133 are kept equal by hydraulic cylinder movable with thrust means at distal end of pipe 1 in a fourth method. As shown in FIG. 33, numeral 143 designates a hydraulic cylinder the same as the hydraulic cylinder 133 in FIG. 31. It is provided with rollers 144 rollable on guide rails 145 provided on the body portion of the apparatus in parallel to the axis XX'. This method is otherwise same as the third method. Hydraulic cylinder 143 is connected to hydraulic pressure adjuster 142, and during the bending, load is applied to the distal end of pipe 1 and adjusted to become equal to the load of guide roll 4. A noticeable difference from the third method is that the distance $l'$ between the acting point G of hydraulic cylinder 143 and guide roll 4 is far longer than the distance $l$ between guide rolls 3' and 4 during the early phase of bending of the pipe 1, so that the load Fp of guide roll 4 is reduced to consequently improve the bending precision.

In the third and fourth methods, curvature change detecting means 117 is not used, but such means may be used in interlocked relation with hydraulic cylinders 133 and 143.

Also, in each of these methods, if curvature change detecting means 117 is operatively associated with heating means 5 and the heating means 5 is moved in correspondence to change of curvature, it is possible to prevent R flow.

Therefore, it is possible to prevent both R expansion and R flow simultaneously by giving a necessary amount of $\theta_2$ for preventing R expansion while shifting the heating means 5 from the bending position where R flow occurs to the points A and A' gradually during the bending work.

When heating means 5 is moved in the direction of A and A'' in FIG. 27, that is, in the direction opposite to the direction of advancement of pipe 1, the bending radius R may enlarge, so that the bending radius to be set in the apparatus is beforehand reduced to make allowance for such possible enlargement of the bending radius, and the heating point is set at A'' to start the bending from this position. That is, the bending work is practiced while gradually returning the pipe 1 toward the point A from the bending position where R flow is produced.

When bending metal pipe by using the above-described methods and apparatus, it is necessary to correctly swing the arm horizontally for attaining high degree bending precision. To this end, it has been generally attempted to mount a rollable wheel at the lower part of the arm end and to lay a rail horizontally on the floor so that said wheel will roll on the rail during the bending thereby to horizontally secure the arm. According to this method, however, much time and labor is required for laying the rail and also high construction cost is necessitated. There is also involved a danger of inviting accidents since the rail rises up above the floor.

In order to overcome such problem, a wheel rollable on the floor is mounted at the lower part of the arm end through a motor-driven or hydraulic jack. A tilt detecting means is provided at a pertinent part of the arm so that when a tilt occurs on the arm during the bending, such tilt is detected to operate the jack to thereby return the arm to the horizontal position.

The apparatus shown in FIGS. 34 and 35 incorporates such arrangements. In the figures, numeral 146 designates a motor-driven jack mounted at the lower part of the end portion of arm 7, 147 a motor therefor, 148 a lifting shaft, 149 a bearing provided at the bottom of the lifting shaft 148, and 150 a wheel pivotally secured to the bearing 149, 151 a pendulum pivoted to a block 152. Terminals 153 and 154 attached to the block 152 while suitably spaced apart from each other on both sides of the end portion of the pendulum, a switch mechanism 155 for controlling forward and reverse rotations of motor 147 are provided.

This switch mechanism 155 is mounted with the block 152 such that when arm 7 stays horizontal, the end portion of the pendulum 151 will be positioned intermediate both terminals 153 and 154. When arm 7 slants, the end portion of the pendulum 151 touches the terminals 153 or 154 to detect such slant. Thus, the switch mechanism 155 is electrically connected to the pendulum 151, terminals 153, 154 and motor 147 so that when arm 7 slants in its swinging stroke and such slant is detected by said pendulum 151 and terminal 153 or 154, the motor 147 of the motor-driven jack 146 is operated to let the arm 7 restore its horizontal position.

In other words, if arm 7 is slanted such that its wheel side is raised up high due to unevenness on the floor surface, the end of pendulum 151 touches terminal 153 to drive motor 147 to induce upward movement of lifting shaft 148, whereby the wheel side of arm 7 is now lowered to allow arm 7 to assume its horizontal position. When arm 7 is thus horizontal, pendulum 151 also returns to its original position and its end portion separates from terminal 153 to shut down the motor 147. On the other hand, if arm 7 is slanted such that its wheel side is lowered, the end of pendulum 151 touches terminal 154 to drive motor 147 reversely to lower the lifting shaft 148 to raise up the wheel side of arm 7 to thereby let the arm assume its horizontal position. When arm 7 is horizontal, motor 147 is shut down.

Thus, since arm 7 is always kept in its horizontal position throughout the bending, it is possible to accomplish the bending with high precision. The apparatus itself is also very simple in construction and hence can be manufactured at low cost.

As described above, the methods and apparatus according to the present invention are capable of bending long materials such as pipe, bar and rod free of spring back and without causing the undesirable phenomenon of flattening, flexing, buckling or R flow.

While the present invention has been described by way of embodiments where the invention has been used for bending of steel pipes, it will be apparent that the methods and apparatus of the present invention can as well be applied to bending works of other types of metal rod and bar.

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. In a hot bending method for bending hollow, elongated material such as metal pipe in which material to be worked is passed through a heating device such as a high frequency inductor capable of effecting high temperature heating on a limited area, with a portion of said material being clamped to an arm pivotable in a bending plane about an axis in a plane generally perpendicular to the longitudinal axis of an unbent portion of the material, the arm having a length that matches the bending radius of the material, and then continuously and straightforwardly advancing the material while heating a portion of the material with the heating device to a plastic deformation inducing temperature and thereafter immediately followed by cooling with the application of a bending moment to the material to cause continuous plastic deformation in the heated portion of the material, the improvement wherein a crushing load is applied to a bent portion of the material near its high temperature plastic area from a direction normal to the plane of the bending, without applying any significant force in the plane of the bending, immediately following heating and cooling, thereby inhibiting flattening of the material to perform the desired bending.

2. An apparatus for hot bending metal materials such as circular metal pipes, comprising:

means for continuously advancing a metal material to be bent;

means for guiding an unbent portion of the metal material so that it moves straight ahead;

annular heating means for heating a limited area of the material to a high temperature;

cooling means for cooling the material immediately after the heating thereof;

an arm which is freely pivotable about an axis located within the plane of said heating means, said arm being also adapted to clamp a leading portion of the metal material to guide the leading portion of the metal material to apply a bending moment to the metal material in a bending plane; and, means for applying pressure to a bent portion of the metal material having been advanced past the heating means and cooling means, the pressure being applied in a direction generally parallel to the pivoting axis of the arm, without applying any significant force in the plane of the bending.

3. The metal pipe bending apparatus of claim 1 wherein said pressure applying means includes at least one roll engaging the bent portion of said pipe.

4. The bending apparatus of claim 2 wherein said pressure applying means includes a pair of opposed cylindrical rollers engaging the material, the axes of said rollers being perpendicular to the direction in which the pressure is applied.

5. An apparatus for bending elongated materials comprising:

a pivotable arm, carrying a clamp for engaging a leading portion of the material, said arm and said guiding means cooperating to apply a bending force to the material;

heating means, through which the material passes, located between said guide means and said clamp, for locally heating the material;

means, located between said heating means and said clamp, for receiving the material advanced therethrough and applying a force generally perpendicular to the bending force to inhibit flattening of the material; and, means for guiding and advancing an unbent portion of the material so that a bent portion of the material is advanced through said force applying means.

6. The apparatus of claim 5 further comprising:

at least one pressure applying clamp for applying a force generally perpendicular to the bending force to inhibit flattening of the material, said pressure applying clamp being positioned on the bent portion of the material between said force applying means and said clamp carried by said pivotable arm.

* * * * *